United States Patent [19]

Niksa et al.

[11] Patent Number: 5,017,275

[45] Date of Patent: May 21, 1991

[54] ELECTROPLATING CELL ANODE

[75] Inventors: Andrew J. Niksa, Concord; Gerald R. Pohto, Mentor, both of Ohio

[73] Assignee: Eltech Systems Corporation, Boca Raton, Fla.

[21] Appl. No.: 425,084

[22] Filed: Oct. 23, 1989

[51] Int. Cl.[5] ..... C25D 17/00; C25D 17/10

[52] U.S. Cl. ..... 204/206; 204/286

[58] Field of Search ..... 204/206, 286

[56] References Cited

U.S. PATENT DOCUMENTS

| | | | |
|---|---|---|---|
| 4,119,515 | 10/1978 | Costakis | 204/211 |
| 4,318,794 | 3/1982 | Adler | 204/216 |
| 4,642,173 | 2/1987 | Kozio et al. | 204/242 |

OTHER PUBLICATIONS

U.S. patent application Ser. No. 309,518, filed Feb. 10, 1989, applicant Andrew J. Niksa et al.

U.S. patent application Ser. No. 175,412, filed Mar. 31, 1988, applicant Gerald R. Pohto et al.

*Primary Examiner*—T. M. Tufariello

*Attorney, Agent, or Firm*—John J. Freer

[57] ABSTRACT

The present invention resides in an anode structure as well as in an electrolytic cell utilizing the anode structure. The anode structure comprises a resilient anode sheet having an active anode surface, and a support substructure for the anode sheet. The anode substructure has a predetermined configuration. Means are provided for flexing the anode sheet onto the anode substructure so that the anode sheet conforms to the configuration of the anode substructure and at the same time provides an adequate electrical junction for uniform current distribution.

35 Claims, 3 Drawing Sheets

ELECTROPLATING CELL ANODE

BACKGROUND OF THE INVENTION

TECHNICAL FIELD

The present invention relates to an anode for an electrolytic plating cell for plating continuous strip, and particularly to an anode having a replaceable, electrocatalytically coated active surface.

DESCRIPTION OF PRIOR ART

Electrocatalytically coated anodes for continuous electrolytic coating of large objects, for instance metal plating of steel coils, are well known. An example of an electrolytic deposition process is electrogalvanizing strip steel. For such deposition, a substrate metal such as steel in sheet form, feeding from a coil, is passed through an electrolytic coating cell, often at high line speed. Electrocatalytically coated anodes for such cells have a long life, and they resist being consumed. This provides a constant gap between the anode the cathode without requiring periodic adjustments. Such anodes usually comprise a substrate made of a valve metal such as titanium, tantalum, or niobium. The active face of the substrate has a coating that can be exemplified by a precious metal such as platinum, palladium, rhodium, iridium, ruthenium, and alloys and oxides thereof. The active face can also be a precious metal oxide, or a metal oxide such as magnetite, ferrite, or cobalt spinel, with or without a precious metal oxide. Despite the long life of these anodes, there is still the need for an anode having an active anode surface which is readily replaceable, or which has segments which are readily replaceable, in the event of damage to the anode or a part of the anode or so that the coating can be renewed, as for a spent anode.

Prior U.S. Pat. No. 4,642,173 discloses an anode for electrolytic deposition of metal from an electrolytic solution onto an elongated strip of metal drawn longitudinally past the anode. The anode is submerged in the electrolytic solution and comprises an active surface which is directed towards the metal strip. The active surface comprises a plurality of lamellas supported so that they conform to the path of the metal strip. Only planar paths for the metal strip are disclosed. The lamellas are welded to a support and thus are not readily replaceable.

Prior U.S. patent application Ser. No. 309,518, filed on Feb. 10, 1989, assigned to assignee of the present application, discloses a substantially planar shaped and inflexible anode having a free face adapted to electrodeposit, for instance by electrogalvanizing, a coating onto a rapidly moving cathode such as a steel coil strip. The anode is desirably stable and is capable of maintaining a uniform spacing with a cathode. The anode comprises anode segments defining a broad flat anode face. At least one of the anode segments is bias cut in relation to the direction of travel of the cathode.

Prior U.S. Pat. No. 4,936,971, filed Mar. 31, 1988, also assigned to assignee of the present application, discloses a massive and inflexible anode of generally planar shape which contains a mosaic of modular anodes. Each modular anode has an electrically conductive support plate serving as a current distributor for the modular anode. The modular anode has an active surface facing the strip being electroplated. A plurality of fasteners are welded to the opposite inactive face of each modular anode. The fasteners are, in turn, bolted to the support plate.

Prior U.S. Pat. No. 4,119,115 discloses an apparatus for electroplating an elongated strip of metal drawn longitudinally past a positively charged anode assembly submerged in a bath of an electrolytic solution. The anode assembly comprises a plurality of flat segments which are bolted to a support frame. The segments can be vertically or horizontally arranged in the electrolytic bath. In the event of damage to one segment, that segment can be replaced without replacing the entire anode assembly.

SUMMARY OF THE INVENTION

The present invention in one aspect resides in an anode structure especially adapted for conformance with a cathode of unusual shape, which anode comprises a rigid support anode substructure member, said substructure member having a predetermined configuration; a resilient anode sheet element having an active anode surface; and means flexing said anode sheet element onto said anode substructure member so that said active anode surface conforms at least substantially to said anode substructure member configuration.

Other invention aspects include an electroplating assembly, plus a method of making an anode.

In a preferred embodiment of the present invention, the electroplating cell is an electrogalvanizing cell and the cathode strip can be in strip form which may be a strip of steel. Also, in an embodiment of the present invention, the path of travel of a cathode covers a segment of a cylinder and the support anode substructure is radially disposed with respect to such path of travel and equidistantly displaced at all points from said path of travel. The anode sheet preferably comprises a plurality of segments independently held on the support anode substructure member.

BRIEF DESCRIPTION OF THE DRAWINGS

Further features of the present invention will become apparent to those skilled-in-the-art to which the present invention relates from reading the following specification with reference to the accompanying drawings, in which.

DESCRIPTION OF THE PREFERRED EMBODIMENTS

The electrolytic cell of the present invention is particularly useful in an electroplating process in which a deposit of a metal, such as zinc is made onto a moving cathode strip. An example of such a process is electrogalvanizing in which zinc is continuously galvanized onto a strip fed from a steel coil.

However, the electrolytic cell of the present invention can also be used in other electrodeposition processes, for instance plating other metals such as cadmium, nickel, tin, and metal alloys such as nickel-zinc, onto a substrate. The cell of the present invention can also be used in non-plating processes such as anodizing, electrophoresis, and electropickling, where a continuously moving strip of metal is passed through a cell bath. The anode of the electrolytic cell of the present invention can also be used in such non-plating applications as batteries and fuel cells, and in such processes as the electrolytic manufacturer of chlorine and caustic soda.

Figure 1:
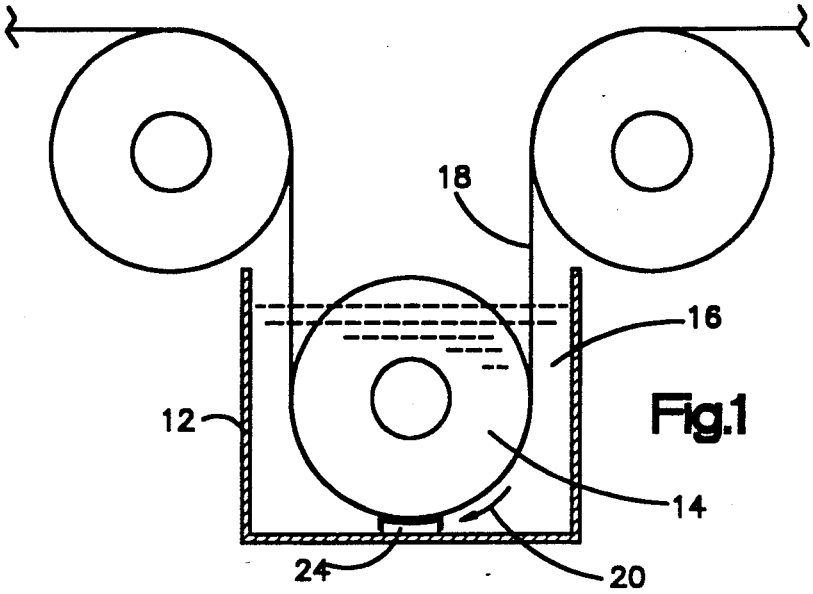
FIG. 1 is a schematic, elevation, section view of an electroplating cell for electroplating a continuous strip in accordance with the present invention.

Referring to FIG. 1, the electrolytic cell 12, of the present invention comprises a cylindrical roller 14 which is at least partially immersed in an electrolytic bath 16. A continuous strip 18, for instance a strip of steel, is fed from a coil (not shown) into the bath and around the roller 14. The strip 18 functions, in the embodiment illustrated, as the cell cathode. Currents can be supplied to the strip 18 through the roller 14, or by other means well known in the electrodeposition art.

The cathode strip 18 moves circumferentially on the cylindrical roller 14. In the case of galvanizing, a strip such as of steel moves rapidly along a path of travel shown by arrow 20 which is defined by the cathode roller 14 and which generally conforms the surface of the roller 14.

Figure 2:
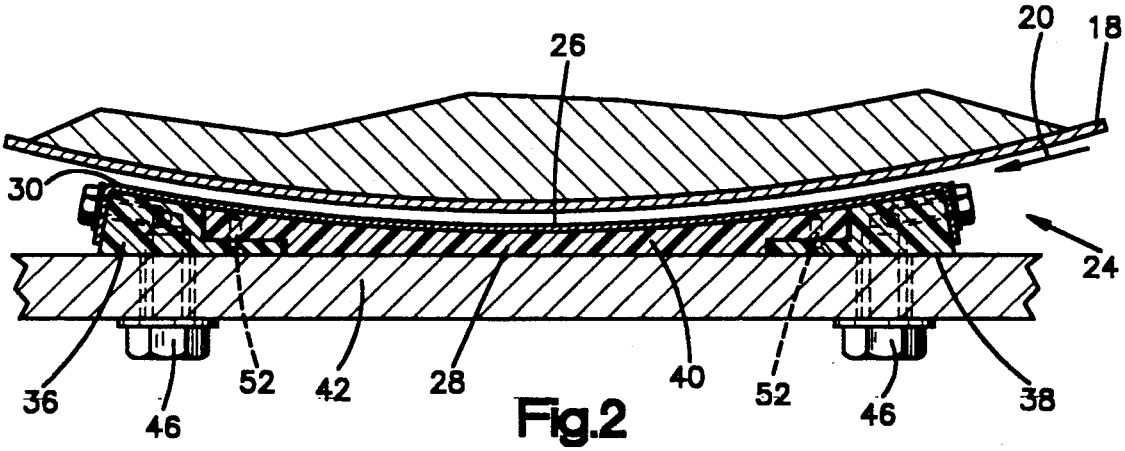
FIG. 2 is an enlarged elevation section view of a portion of the electroplating cell of FIG. 1 showing the cell anode.

The electrolytic cell 12 comprises an anode 24. Details of the anode are shown in FIG. 2. The anode 24 comprises an anode sheet 26 and an anode substructure 28. The anode sheet 26 has an active anode surface 30 which faces the cathode strip 18. Preferably, the active anode surface 30 is an electrocatalytic coating. Examples of electrocatalytic coatings are platinum or other platinum group metals such as palladium, rhodium, iridium, ruthenium, and alloys thereof. Alternatively, the active coating can be an active oxide such as a platinum group metal oxide, magnetite, ferrite, and cobalt-spinel. The active oxide coating can also be a mixed metal oxide coating developed for use as an anode coating in electrochemical processes. The platinum group metal and mixed metal oxides for the coatings are such as disclosed in U.S. Pat. Nos. 3,265,526, 2,632,498, 3,711,385, and 4,528,084. The disclosures of these patents are incorporated herein by reference. Mixed metal oxides include at least one of the oxides of the platinum group in combination with at least one oxide of a valve metal or other non-precious metal.

The anode sheet 26 to which the active anode surface 30 is applied can be any metal which is suitably resistant to the electrolyte and is electrically conductive. Such metals include the valve metals such as titanium, tantalum, and niobium, as well as their alloys and intermetallic mixtures. Advantageously, for combining electrical conductivity with resistance to electrolyte, the sheet is titanium or a plated metal such as titanium clad copper, aluminum or steel.

The anode sheet 26 can be supplied as a thin gauge resilient rolled sheet having sufficient flexibility so that it can be flexed into an operative position using fasteners, e.g., the bolts 62 (FIG. 5), and a torque applied using hand operated tools. Also, it should have sufficient thickness to carry current from a current connection throughout the anode active surface 30, and sufficient strength or memory that it retains, in the absence of applied force, the shape imparted to it by rolling or other forming. Broadly, by way of example, the anode sheet 26 has a thickness of about 0.01 inch to about 0.5 inch. A thin, coated titanium sheet rolled, or otherwise formed, preferably has a thickness of from about 0.100 to about 0.25 inch. The thinner sheets of about 0.25 inch thickness or less can be easier to install and coat, and have a lower material cost.

In the embodiment of FIG. 2, the anode substructure 28 comprises end bars 36, 38 which extend the full width of the substructure 28, and an intermediate filler plate 40 which is positioned between the end bars 36, 38. The end bars 36, 38 and the filler plate 40 seat on a suitable flat support substrate 42. The support substrate 42 is not part of the present invention and is not described herein in detail, it being understood that such can be expected to be metallic, e.g., titanium, copper or steel. Together, the end bars 36, 38 and filler plate 40 define a concave upper surface which is machined or fabricated to very close tolerances to match the path of travel 20 of the cathode strip 18. By "matching", it is meant that the concave surface is substantially equidistantly spaced at all points from the path of travel 20 and concentric to the surface of the cathode roller 14.

As shown in FIG. 2, the end bars 36, 38 are bolted by means of spaced apart bolts 46 to the support substrate 42. The filler plate 40, in turn, is provided with flanges 50 (FIG. 4) which are secured to, by spaced apart screws 52, the inside seats 54 of the end bars 36, 38.

The anode substructure 28 broadly can be made of any material capable of being precision machined or fabricated to close tolerances, which is compatible with the chemical environment of the cell, and which provides electrical conductivity for current distribution to the anode sheet 26. The anode substructure 28 also should have sufficient mechanical strength to remain rigid while holding the anode sheet 26 in the desired shape. In the specific case of electrogalvanizing, the end bars 36, 38 are typically made of a valve metal and preferably of titanium or its alloys or intermetallic mixtures, while the filler plate 40 may be metallic or ceramic, but is preferably of a high strength plastic (polymeric) material which is resistant to the chemical environment of the cell. The titanium preferred end bars provide highly desirable current carrying capability as well as rigidity. It is however broadly contemplated to manufacture the entire substructure of end bars 36, 38 and filler plate 40 of titanium, or other valve metal, as well as to use one or more segments, rather than one solid piece for the filler plate 40. Other materials that may be used include clad or coated structures, for instance steel clad with titanium. Examples of suitable high strength polymeric materials for the filler plate 40 include polyhalocarbon polymers, e.g., polytetrafluoroethylene, polyamide polymers such as nylon and polyolefins such as ultra high molecular weight polyethylene.

Figure 3:
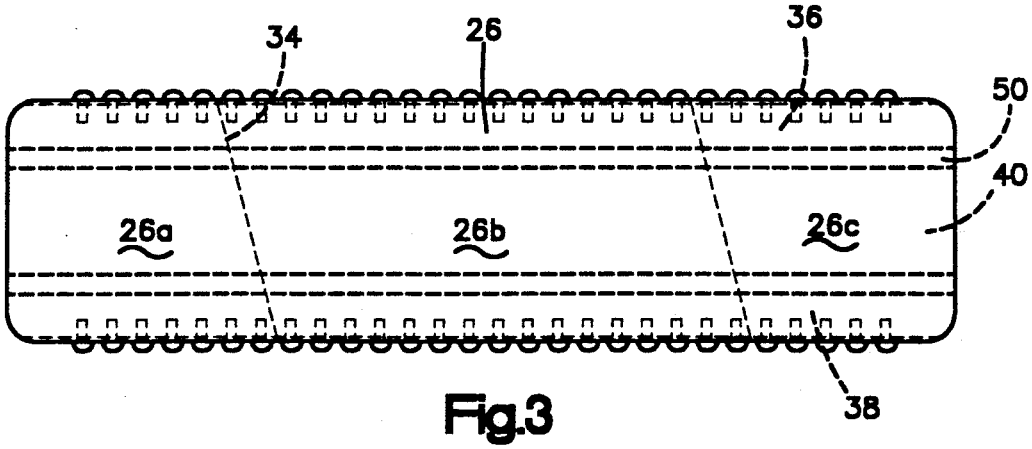
FIG. 3 is a plan view of the anode of FIG. 2, but with the anode turned 90° from its position in FIG. 2.

As shown in FIG. 3, the anode sheet 26 is in the form of a plurality of segments **26*a*, 26*b*, and 26*c*, positioned side-by-side across the width of the anode. The segments are separated by lines of separation 34 that are biased with respect to the direction of travel of a cathode strip. This avoids unevenness of the plating of the strip due to edge effects. The anode sheet 26 is mounted over the filler plate 40, with its flanges 50 (FIG. 4), as well as mounted over the end bars 36, 38**.

Figure 4:
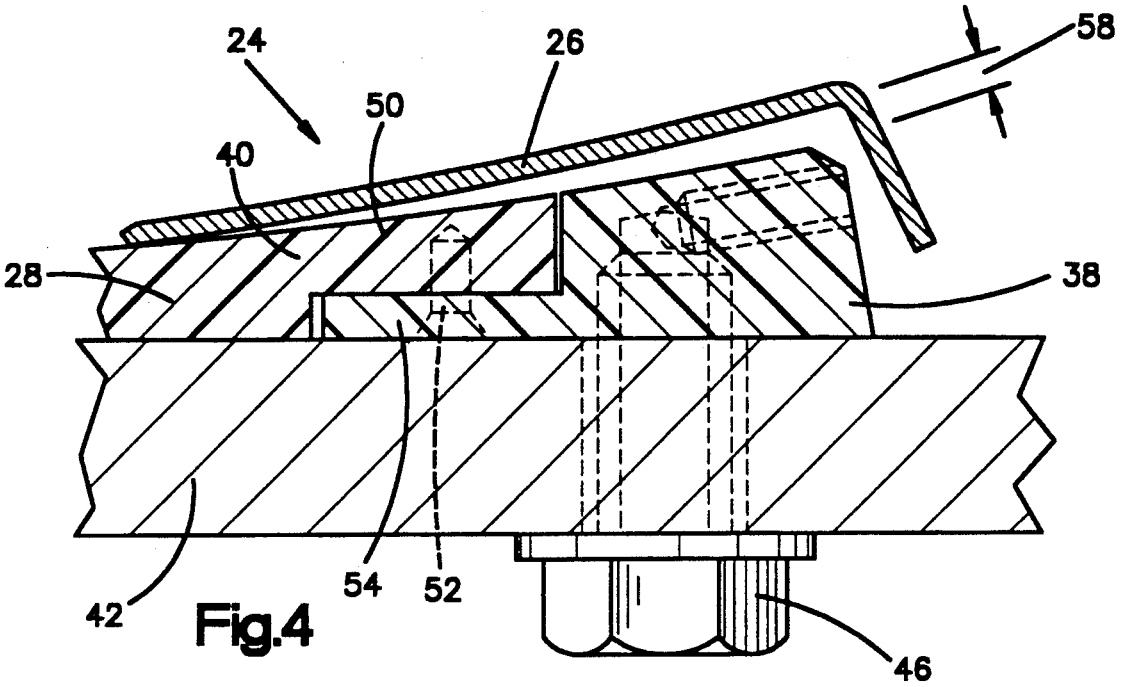
FIG. 4 is a section view showing a portion of the anode of FIG. 2 prior to assembly.
Figure 5:
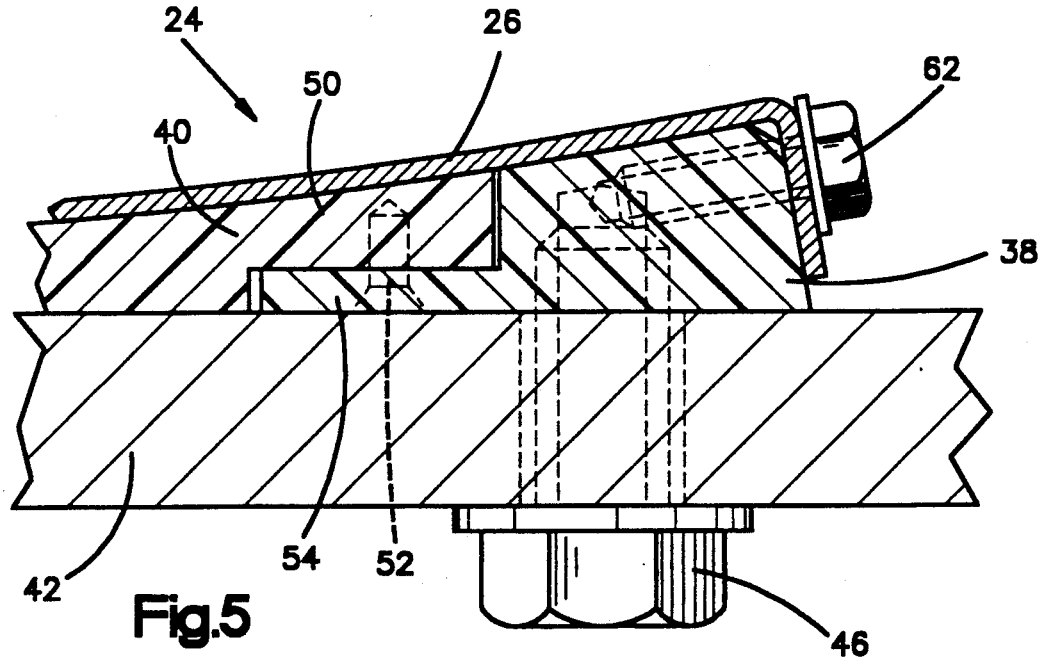
FIG. 5 is a section view showing a portion of the anode of FIG. 2 following assembly.

FIGS. 4 and 5 show a representative fabrication technique for one embodiment of the anode of the present invention. In this fabrication of the anode 24, the anode sheet 26 is formed with a radius which is less than the radius of the concave surface defined by the end bars 36,38 and the filler plate 40. In this way, the anode sheet 26 when placed upon the concave surface in an only partially flexed state, can have an about one to two millimeter gap 58 along the sheet edges as shown in FIG. 4. To conform the anode sheet 26 to the machined close tolerance concave surface of the sheet substrate, the edges of the anode sheet are flexed downwardly and secured to the end bars 36, 38 by means of bolts 62 (FIG. 5). Flexing the anode sheet down in this manner forces it to conform exactly to the concave surface of the anode substructure 28. Furthermore, securing the anode sheet 26 in this way secures the end bars 36, 38 by the bolts 62 on the side of the anode sheet 26. This is removed from the active area of the anode sheet 26, thereby avoiding problems such as uneven plating due to fasteners. Also, the active anode surface need not extend to the side area under the bolts 62. It is also contemplated that a serviceable embodiment of the invention can be provided when the anode sheet 26 is formed with a radius of curvature which is greater than the radius of the concave surface defined by the end bars 36, 38 and the filler plate 40. The anode sheet 26 may then be only partially flexed to be in contact with, and fastened to, the end bars 36, 38. Such positioning will thereby retain a gap between the anode sheet 26 and the filler plate 40.

The current distribution to the anode sheet 26 is through the bolts 46 which secure the end bars 36, 38 to the support substrate 42. The connections (not shown) preferably are made such that the current is distributed in the direction of travel of strip 18. In the embodiment of FIGS. 1–5, this is from end bar 38 to the anode sheet 26 to the end bar 36.

The present invention has advantages over other anode designs in that it allows the use of thin coated anode sheets which are more easily replaced and recoated than conventional anodes, as well as being less expensive than conventional anodes. The present invention also allows for replacing segments so that only spent or damaged anode sheet segments need to be replaced. The substructure 28, while being moderately expensive, need only typically be fabricated and installed once, and serves the functions of maintaining tolerances and distributing current. This allows a less critical tolerance, and less material, for the coated anode sheets. In conventional designs, the anodes are thick machined parts, each requiring the ability to carry current. The parts must be of high tolerance and thus higher costs. The thickness of the conventional anodes as well as the machined surfaces makes applying a long life high quality coating more difficult.

The present invention is applicable to substructures other than those having a concave configuration. For instance, the present invention can be used with anodes that are flat, or which have a convex configuration. For instance, for a flat anode, the anode substrate can be flat, and the anode sheet can be a cylindrical segment or curved so that it has to be flexed into conformity with the substructure surface. It is also contemplated that for a flat substructure and a cylindrical segment shaped anode, that the anode can be partially flexed or the like whereby it is mounted on a flat substructure but retains curvature such as for example to retain conformity with a complementary cathode curvature. In the case of a convex curved or cylindrical anode, the anode sheet may have a larger radius that the substructure. The anode sheet is then flexed into position by wrapping it around the substructure. In such case, the anode sheet would be placed in tension, for instance by a band clamp, to make it conform to the shape of the substructure.

Figure 6:
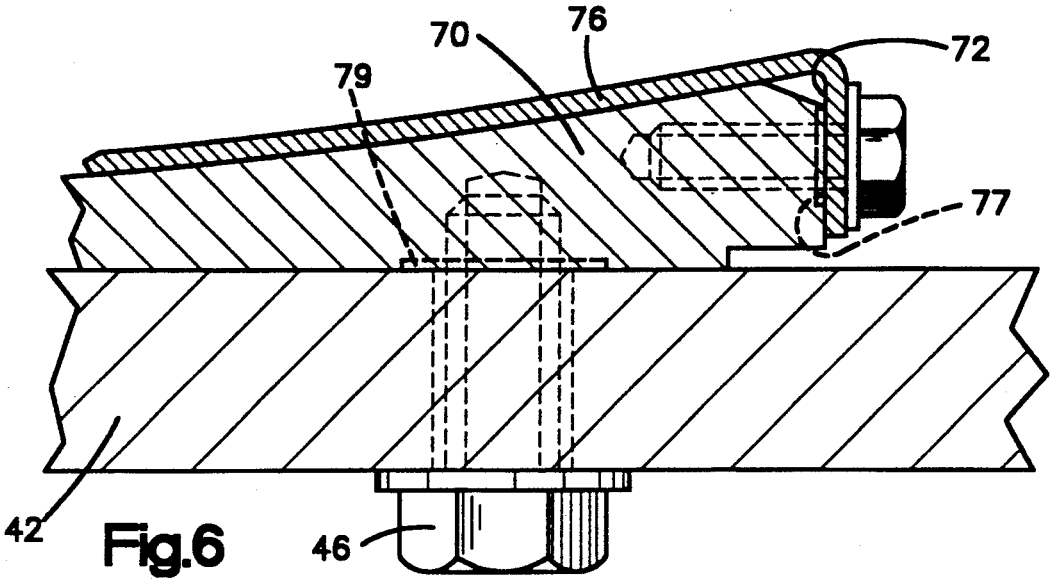
FIG. 6 is a partial elevation section view of an anode illustrating an embodiment of the present invention.

An embodiment of the present invention is illustrated in FIG. 6. In this figure, the substructure 70 is a solid coated titanium plate in which opposed edges 72 are vertically aligned rather than at an angle as in the embodiments in FIGS. 1–5. In the embodiment of FIG. 6, there is no filler plate insert between end bars. Furthermore, for enhancing electrical conductivity there is a voltage-minimizing coating 77 between the substructure 70 and the support substrate 42 at the bolt 46.

Figure 7:
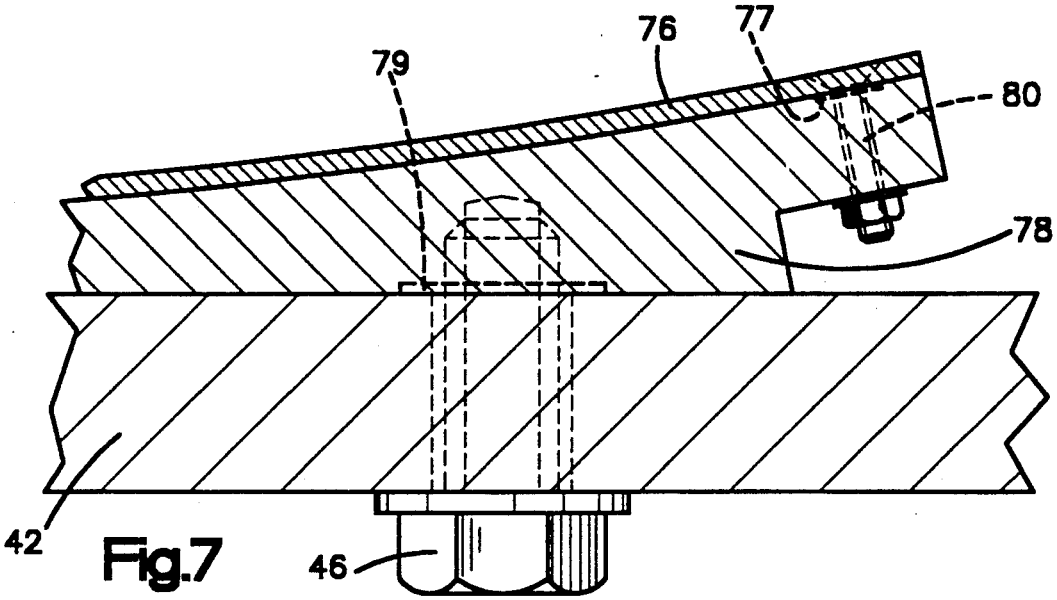
FIG. 7 is a partial elevation section view of an anode illustrating another embodiment of the present invention.
Figure 8:
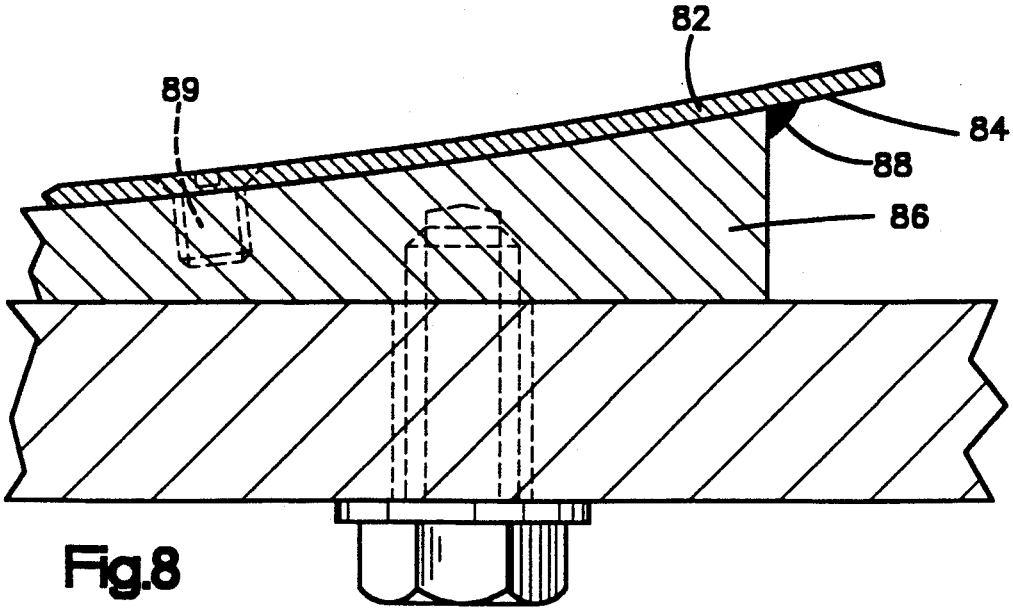
FIG. 8 is a partial elevation section view of an anode illustrating a still further embodiment of the present invention.

FIGS. 7 and 8 illustrate still further embodiments of the present invention. In the embodiment of FIG. 7, the anode sheet 76 is fastened to the substructure 78 by means of flathead screws 80 countersunk into the surface of the anode sheet. At the juncture of the screws 80 with the substructure 78 there is a voltage-minimizing coating 77. A similar such coating 79 is placed between the substructure 78 and the support substrate 42 at the bolt 46. It is to be understood that such a coating 77, 79 is contemplated as being useful for the structure of any of the figures where a connection is obtained between electrically conducting elements. In the embodiment of FIG. 8, the anode sheet 82 is rolled to a desired radius and then fixed at this radius by welding the curved sheet 82 on its inactive side 84 to the substructure 86 as with the weld 88. The substructure 86 in this embodiment may be a plurality of spaced-apart curved I-beams which are suitably shaped and held together. The I-beams would serve as current distributors as well as the substructure support. The welding can be supplemented by using countersunk screws 89 for fastening the anode sheet 82 to the substructure 86. In an embodiment where the substructure 86 is apertured, the screws 89 could be replaced with studs, not shown, welded to the inactive side 84 of the anode sheet, and bolted from below within the apertures of the substructure 86. It is also contemplated that the countersunk screws 89, with or without studs, could be utilized when welding the anode sheet 76 to the substructure 78 and that brazing may also be employed when fastening the anode sheet 76 to the substructure 78. Usually, the use of removable metal fasteners, e.g., bolts and screws, is preferred where the anode sheet 26 is segmented and segments will be removed for refurbishing or replacement.

For the bolts 46 and 62, and the screws 52, 80 and 89, it is most desirable to use a highly conductive metal, e.g., copper. Such might be copper, copper alloy or steel, including stainless and high strength steel. Since copper metal might be subject to attack, as from the electrolyte in an electrogalvanizing environment, copper connectors will usually be covered, including cladding, plating, explosion bonding or welding, with a more inert metal, i.e., a valve metal. Where a voltage-minimizing coating is utilized, application by electroplating operation is preferred for economy, although other coating operations, e.g., brush plating, plasma arc spraying or vapor deposition, may be employed. For the metal titanium, e.g., when used as the anode sheet 76 and there will be a coating 77 between the sheet 76 and the substructure 78, it is advantageous to use a plated noble metal coating. Such a noble metal coating is a coating of one or more of the Group VIII or Group IB metals having an atomic weight of greater than 100, i.e., the metals ruthenium, rhodium, palladium, silver, osmium, iridium, platinum and gold. Preferably for efficiency in enhanced electrical contact, platinum plating is used.

What is claimed is:

1. An anode structure especially adapted for conformance with a cathode of unusual shape, which anode structure comprises:

a rigid support anode substructure member, said substructure member having a predetermined configuration;

a thin and resilient, but solid and flexible anode sheet element having a broad, active anode surface; and means flexing said anode sheet element onto said anode substructure member, so that said broad, active anode surface conforms at least substantially to said anode substructure member configuration, and a broad anode surface, opposite said active anode surface, is in intimate, flexed contact with said anode substructure member.

2. The anode structure of claim 1, wherein said solid anode substructure member is segmented into solid end bar members connected by a solid filler plate member.

3. The anode structure of claim 2, wherein said end bar members are metal end bars and said filler plate member is a metal, ceramic or polymeric filler plate member.

4. The anode structure of claim 1, wherein said anode substructure member acts as a current distributor member for said anode sheet element.

5. The anode structure of claim 1, wherein said anode substructure member has a surface configuration shaped in conformance with a surface of an opposing cathode.

6. The anode structure of claim 3, wherein said metal end bar members are titanium, tantalum or niobium end bar members, or their alloys or intermetallic mixtures, and said filler plate member is a polyhalocarbon, polyamide or polyolefin filler plate member.

7. The anode structure of claim 1, wherein said anode sheet element is a thin, flexible coated metal plate.

8. The anode structure of claim 7, wherein said thin metal plate has an electrocatalytic coating on a broad face of said plate as said active anode surface.

9. The anode structure of claim 7, wherein said thin metal plate has thickness of from about 0.01 inch to about 0.5 inch.

10. The anode structure of claim 1, wherein said anode sheet element is segmented with adjacent segments having opposing edges that are biased to the path of travel of a moving cathode.

11. The anode structure of claim 1, wherein said anode sheet element is a metal element of titanium, tantalum, niobium, their alloys or intermetallic mixtures.

12. The anode structure of claim 1, wherein said anode sheet element active anode surface conforms in shape with a surface of an opposing cathode and is secured to said anode substructure member by fasteners removed from the active area of the anode sheet element.

13. The anode structure of claim 1, wherein said cathode is a roller cathode and said anode surface prescribes an arc, spaced apart and in concentric relationship to said roller cathode.

14. The anode structure of claim 1, wherein said means flexing said anode sheet element onto said anode substructure member includes fastening means securely fastening said element to said member and said means includes weld, braze, screw, bolt or explosion bonding means.

15. The anode structure of claim 8, wherein said electrocatalytic coating contains a platinum group metal or contains at least one oxide selected from the group consisting of platinum group metal oxides, magnetite, ferrite and cobalt oxide spinel.

16. The anode structure of claim 8, wherein said electrocatalytic coating contains a mixed oxide material of at least one oxide of a valve metal and at least one oxide of a platinum group metal.

17. An electrolytic cell comprising:

a cathode;

an anode comprising a thin and resilient, but solid and flexible anode sheet having a broad, active anode surface and a rigid support anode substructure member for said anode sheet, said anode substructure member having a predetermined configuration;

means fixing said anode sheet onto said anode substructure member, so that said broad, active anode surface conforms to said anode substructure member configuration and has a broad anode surface, opposite said active anode surface, which is in intimate, flexed contact with said anode substructure member.

18. The electrolytic cell of claim 17, wherein said anode substructure member has a concave configuration.

19. The electrolytic cell of claim 17, wherein said active anode surface is exposed to said cathode and said surface also conforms to the configuration of a surface of said cathode.

20. The electrolytic cell of claim 17, wherein said cell is an electroplating cell utilized for electrogalvanizing, electrotinning or copper foil finishing.

21. An electroplating cell for depositing a coating onto a moving cathode in strip form comprising:

an electroplating bath;

means guiding said cathode strip so that it follows a predetermined path of travel in said bath;

an anode, immersed in said electroplating bath, and comprising a thin a resilient, but solid and flexible anode sheet having a broad, active anode surface, and an anode substructure for said anode sheet, said anode substructure having a configuration which matches said path of travel of said cathode strip;

said anode sheet having a non-flexed configuration different from said anode substructure configuration and a flexed configuration which conforms to said substructure configuration; and means for holding said anode sheet on said anode substructure in said flexed configuration with a broad anode surface, opposite said active anode surface, being in intimate, flexed contact with a broad surface of said anode substructure.

22. The electroplating cell of claim 21, wherein said anode substructure has a concave configuration.

23. The electroplating cell of claim 21, wherein said electroplating cell is an electrogalvanizing cell, electrotinning cell, or cell for copper foil finishing.

24. The electroplating cell of claim 21, wherein said active anode surface is radially disposed in concentric relationship with respect to said predetermined path of travel.

25. The electroplating cell of claim 21, wherein said anode sheet is in segments, said segments being bias-cut with regard to said cathode strip predetermined path of travel.

26. The electroplating cell of claim 21, wherein said anode sheet has an initial radius prior to flexing which is less than the radius of said anode substructure.

27. The electroplating cell of claim 21, wherein said anode sheet is removably bolted to said anode substructure.

28. The electroplating cell of claim 21, further comprising current connections so that electric current is distributed into the anode sheet in the direction of said cathode strip predetermined path of travel.

29. The electroplating cell of claim 28, wherein the current is distributed to said anode sheet through said anode substructure.

30. An anode support substructure having a broad surface spaced apart and in concentric relationship to a roller cathode, which substructure is a current distributor for an anode electrically connected to, and conforming to a surface of, said substructure, said substructure comprising solid end bar members spaced apart from one another but interconnected by a solid central filler member.

31. The anode support substructure of claim 30, wherein said end bar members each connect through overlapping flanges to said central filler member.

32. The anode support substructure of claim 30, wherein said end bar members are metallic and said central filler member is metallic, polymeric or ceramic.

33. The anode support substructure of claim 30, wherein said anode is a flexible anode in sheet form.

34. An electroplating assembly comprising a moveable cathode for receiving a metallic electrodeposited coating, an electrolyte for providing said coating, means guiding said cathode so that it follows a predetermined path of travel in said electrolyte, said assembly further including the anode structure of claim 1.

35. The method of making an anode, which method comprises:

establishing a rigid support anode substructure having a predetermined surface configuration;

providing a thin and resilient, but solid and flexible anode in sheet form and having a broad, active anode surface, said flexible sheet anode having a surface configuration different from the surface configuration of said support anode substructure;

flexing said resilient sheet anode into surface conforming relationship onto said support anode substructure with a broad anode surface conforming in surface-to-surface, flexed contact with a broad surface of said support anode substructure; and electrically connecting said flexible sheet anode and substructure.

* * * * *